United States Patent [19]

Chulay et al.

[11] 4,400,166

[45] Aug. 23, 1983

[54] TOP LOADING CENTRIFUGE ROTOR

[75] Inventors: Steven J. Chulay, Los Altos; Daniel G. Crotty, San Jose, both of Calif.

[73] Assignee: Beckman Instruments, Inc., Fullerton, Calif.

[21] Appl. No.: 334,841

[22] Filed: Dec. 28, 1981

[51] Int. Cl.[3] ..... B04B 9/12

[52] U.S. Cl. ..... 494/20

[58] Field of Search ..... 494/16, 20, 21

[56] References Cited

U.S. PATENT DOCUMENTS

| | | | |
|---|---|---|---|
| 3,377,021 | 4/1968 | Fox et al. | 233/26 |
| 3,687,359 | 8/1972 | Scanlon | 233/26 |
| 3,997,105 | 12/1976 | Hayden | 494/16 |
| 4,254,905 | 3/1981 | Baumler | 494/20 |

*Primary Examiner*—Robert W. Jenkins

*Attorney, Agent, or Firm*—R. J. Steinmeyer; F. L. Mehlhoff; Al A. Canzoneri

[57] ABSTRACT

A swinging bucket centrifuge rotor having a plurality of cavities spaced about its vertical axis and extending entirely through the rotor. Each cavity is adapted to receive a bucket supported by a hanger rod. The mounting of the bucket is such that the bucket can pivot or swing from a vertical to a horizontal position during operation. Each cavity is provided with a slot, which extends along the underside of the rotor, from the cavity to the periphery of the rotor. The slot has an upper surface adapted to receive the bucket when the bucket is in the horizontal position. A pair of opposed grooves extend partway down the wall of the cavity whereby the ends of the grooves each form a ledge to support an end of the hanger rod by which the bucket is pivotally suspended.

6 Claims, 7 Drawing Figures

TOP LOADING CENTRIFUGE ROTOR

BACKGROUND OF THE INVENTION

The present invention relates to high speed centrifuge rotor including a rotor head and demountable swinging buckets.

Centrifuge rotors of the swinging bucket type typically include a rotor head from which is suspended a plurality of buckets containing the liquid to be centrifuged. The buckets are supported by hangers which enable the buckets to pivot about their mounting axes. When the rotor is stopped, the buckets hang vertically downward under the influence of gravity. When the rotor is spinning, the buckets swing outward in response to centrifugal force.

In a number of prior designs, the hanger incorporates some means to enable limited radial movement of the bucket when the rotor is spinning. The bucket is thereby able to engage a portion of the rotor to gain support against the centrifugal force which is acting on it. Thus, by transferring the load to the rotor, the hanger is relived of having to carry the high G force being exerted on the bucket. In many of these previous designs it has been common to mount the bucket to the rotor from the underside of the rotor. This has the disadvantage that the operator cannot easily view the mounting operation and might mount the bucket incorrectly. As a result, during operation the bucket may not pivot as intended and may become detached from the rotor.

An approach which differed from earlier rotor designs was provided by Michael J. Scanlon in U.S. Pat. No. 3,687,359, issued Aug. 29, 1972. Scanlon disclosed a rotor having cavities which were open to the top of the rotor. This enabled buckets to be mounted in the rotor from the top side. The bucket is provided with a spherical flange which seats in a spherical portion of the cavity. When the rotor is spun, the flanged portion of the bucket pivots in its spherical seat, allowing the bucket to swing from a vertical to a horizontal position. It has been observed that in so-called "ball and socket" designs of this type, there is some tendency for the bucket to stick in the transition between the horizontal and vertical positions. A malfunction of this kind is, of course, likely to have a detrimental effect on the separation process. It has been determined that the sticking problem results from non-uniform friction between the sliding surfaces of the "ball and socket" parts of the bucket and rotor. In view of the relatively large contact area involved, the presence of excessive friction is not altogether surprising.

It will be seen, therefore, that there is a need for an improved centrifuge rotor in which the buckets are mountable from the top side of the rotor and in which the bucket mountings function reliably.

SUMMARY OF THE INVENTION

The present invention provides a swinging bucket centrifuge rotor including a rotor head and swinging buckets which is adapted to rotate about its vertical axis. The rotor head has a plurality of chambers evenly spaced about its vertical axis. Each chamber is constructed to receive and support a bucket on a hanger rod for pivotal movement of the bucket between a vertical position when the rotor head is stationary and a horizontal position when centrifugal force developed through rotation of the rotor head overcomes the influence of gravity on the bucket. Each chamber includes a cavity which extends entirely through the rotor head. A slot is provided in the bottom of the rotor head and extends radially from the cavity to the periphery of the rotor head. The upper surface of the slot is adapted to receive a bucket when it is in the horizontal position. Also provided in the cavity are a pair of opposed grooves extending part way down the wall of the cavity. The ends of the grooves are situated on a horizontal line orthogonal to a vertical plane which includes the vertical axis of the rotor head and the longitudinal axis of the cavity. The ends of the grooves form a ledge in the wall of the cavity to support the end portions of the hanger rod and thereby enable the bucket to pivot under centrifugal force upwardly into the slot of the rotor head. Also provided are buckets having a tubular portion closed at one end and provided with a flange structure adjacent the other end. The latter end has a threaded opening, a threaded cap for closing the opening, and a hanger rod attached to the cap for mounting the bucket in the cavity. At the junction of the cavity and the slot in the rotor head, a shoulder is provided which is adapted to be contacted by the flange structure of the bucket when it is in the horizontal position and thereby transfer support of the bucket from the hanger rod to the rotor head.

DETAILED DESCRIPTION

Figure 1:
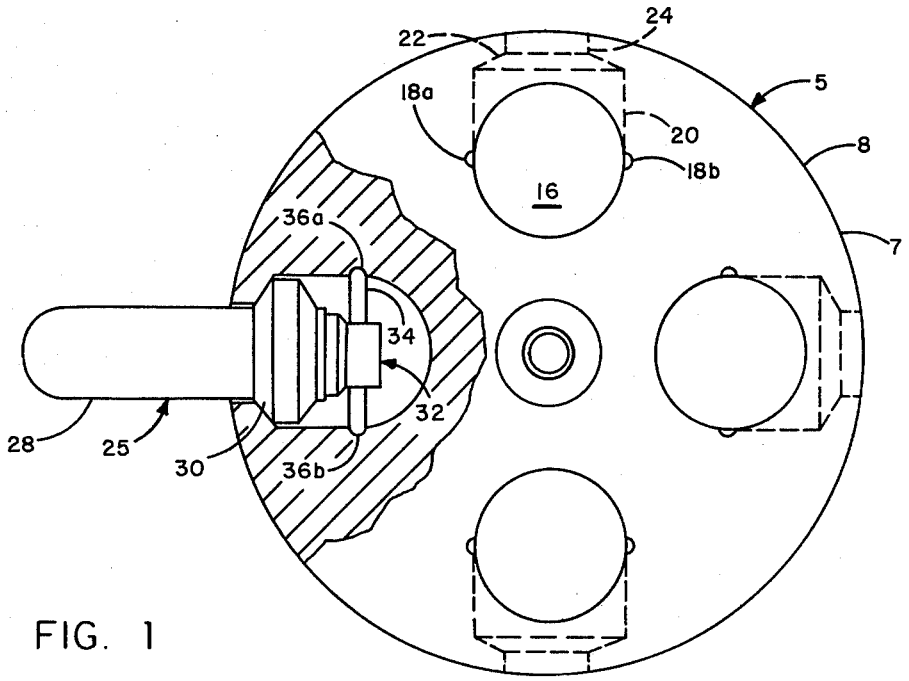
FIG. 1 is a plan view, in partial cross section, showing the rotor head of the present invention.
Figure 2:
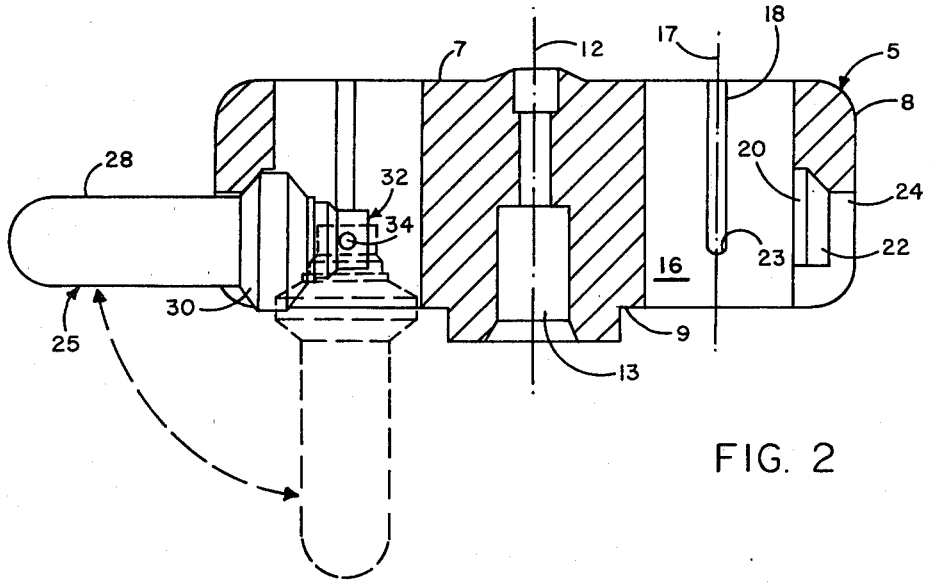
FIG. 2 is a cross-sectional elevation view of the rotor head of FIG. 1.
Figure 3:
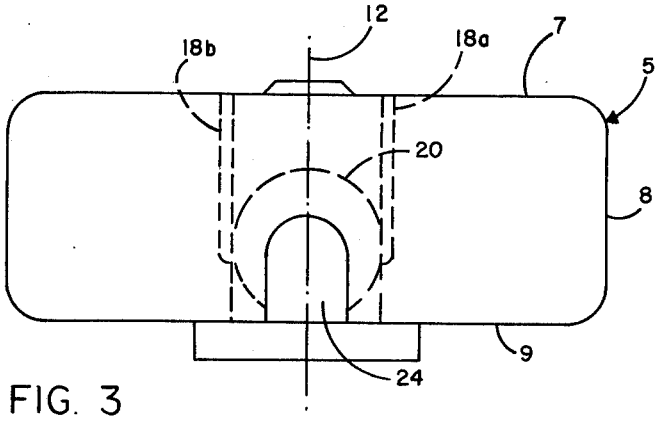
FIG. 3 is an elevation view of the rotor head shown in FIG. 1.

As shown in FIGS. 1–3, reference number 5 generally denotes a centrifuge rotor head having a top surface 7, a peripheral surface 8 and a bottom surface 9. The rotor head has a vertical axis 12 about which it rotates on a drive spindle (not shown) which engages drive hole 13. The rotor head has a plurality of chambers which are constructed to receive and support a bucket on a hanger rod for pivotal movement of the bucket between a vertical position when the rotor head is stationary and a horizontal position when centrifugal force developed through rotation of the rotor head overcomes the influence of gravity on the bucket. Each of the chambers includes a cavity 16 which extends entirely through the rotor head 5 and which has a longitudinal axis 17. A pair of opposed grooves **18*a* and 18*b* extend part way down the wall of each cavity 16. The ends 23 of grooves 18*a* and 18*b* are opposed to each other and are situated on a horizontal line orthogonal to a vertical plane which includes the vertical axis 12 of rotor head 5 and the longitudinal axis 17 of cavity 16. The ends 23 of grooves 18*a* and 18*b* form recessed ledges in the wall of the cavity to support the ends 36*a* and 36*b* of the hanger rod 34 and thereby provide the buckets 25 with a pivotal suspension. Intersecting the wall of cavity 16 is recess 20 which includes shoulder 22. In the mode preferred but to which it will be understood that the invention is not limited, recess 20 is of circular form and nominally concentric with shoulder 22, which is preferably conical in shape and defines an angle of about 35° with respect to the vertical axis. A slot 24 is provided in bottom surface 9 of rotor head 5 extending radially from cavity 16 to peripheral surface 8 and communicating with recess 20 and shoulder 22. In this way, a channel is provided by slot 24 in which the bucket can swing to a horizontal position during centrifugation and, following such action, move radially outward to seat against shoulder 22**.

Each bucket 25 has a tubular portion 28 which is closed at one end and provided with a flange structure 30 adjacent the other end. The flange structure 30 is configured to fit the shoulder 22 of the rotor head. The bucket 25 is adapted to receive a threaded cap 32 which will be described hereinafter.

Figure 4:
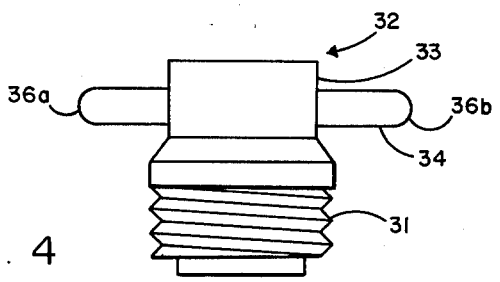
FIG. 4 illustrates a bucket cap and hanger in a first embodiment thereof.

Referring now to FIG. 4, the threaded cap is generally denoted by reference numeral 32. The cap has a threaded portion 31 which is adapted for engagement with screw threads provided in the mouth of centrifuge bucket 25. A hanger rod 34 is disposed transversely of the upper body 33 and has ends 36*a* and 36*b*. The ends 36*a* and 36*b* extend outward of the bucket cap 32 and bucket 25. When the bucket is installed in the cavity, the ends 36*a* and 36*b* engage grooves 18*a* and 18*b* in the wall of the cavity 16 and, by so doing, establish a pivotal suspension for the bucket. The hanger rod 34 is made of a material having suitable spring properties so as to permit elastic deflection of the hanger rod under the load of a given centrifugal force. This deflection in the hanger rod produces an outward radial displacement of the bucket enabling it to seat against the rotor, as will be described in detail below.

In operation, the fluid to be centrifuged is loaded into the buckets 25 which are then sealed by assembly with a threaded cap 32. The buckets are next mounted in the rotor head, with one bucket in each cavity 16. This is accomplished by inserting the bucket, bottom first, into the cavity from the top side 7 of the rotor head. It is necessary that the bucket be oriented so that the ends 36*a* and 36*b* of the hanger rod 34 engage the grooves 18*a* and 18*b* in the wall of the cavity 16. The bucket is allowed to slide downward into the cavity until the hanger rod 34 comes to rest on the recessed ledge formed by the ends 23 of grooves 18*a* and 18*b*. In this arrangement, the bucket is pivotally mounted, so that it hangs vertically under the influence of gravity while the rotor is at rest, and during centrifugal, it is able to swing outward in response to centrifugal force and reach a horizontal position. As the speed of rotation increases, the centrifugal force acting on the bucket increases, as does the beam loading on the hanger rod 34 which is supporting the bucket. The loading causes a deflection in the hanger rod which enables the flange structure 30 of the bucket to seat against shoulder 22 in the rotor head, thereby transferring the centrifugal load from the hanger rod to the rotor head. When the rotor begins to decelerate, the force acting on the bucket decreases. This enables the hanger rod to recover from its deflected state and withdraw the bucket from its seated position. As the rotor head velocity diminishes, the bucket returns to its original vertical position. It is important to note that very little friction is present in the suspension of the bucket 25 by hanger rod 34. As a result, the bucket is able to pivot, seat and recover during the centrifugation cycle with unhampered smoothness.

Figure 5:
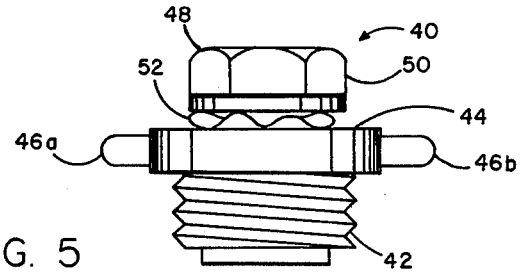
FIGS. 5 and 6 illustrate a bucket cap and hanger in a second embodiment thereof.
Figure 6:
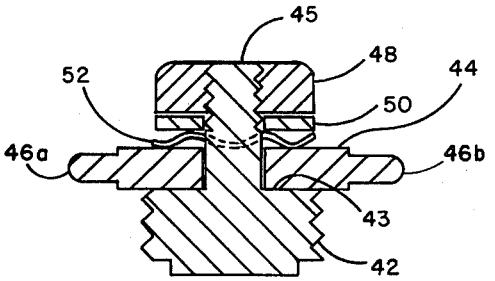

Referring now to FIGS. 5 and 6, the bucket cap of the invention is shown in a first alternate form, generally denoted by reference numberal 40. In this form the cap is provided with a stiff hanger rod and a spring member to permit displacement of the hanger rod to provide a corresponding radial displacement of the bucket at a given rotor velocity. The bucket cap 40 includes a center post 45, a top shoulder 43 and a threaded body 42 which is adapted for sealing engagement with the mouth of bucket 25. Clamped on center post 45 are hanger rod 44, wave washer 52, and flat washer 50 which are retained in stacked assembly by nut 48. The hanger rod 44 is of generally circular shape and has ends 54*a* and 54*b* which project radially from the periphery and are positioned 180° apart. When cap 40 is assembled with a bucket 25, the hanger rod 44 provides a stiff hanger means by which the bucket is pivotally suspended in a rotor cavity 16. The ends 54*a* and 54*b* rest in the recessed ledges formed by the ends 23 of grooves 18*a* and 18*b* in the wall of cavity 16. During operation, centrifugal force acting on the bucket 25 first causes it to pivot from a vertical to a horizontal position. As the centrifugal force increases, it overcomes the spring force of the wave washer 52 resulting in the radial displacement of the bucket which seats it against the rotor head.

Obviously, the spring function of the wave washer 52 could be provided by some other spring means such as, for example, a coil spring, a leaf spring or an elastomeric washer. These substitutes do not offer any advantage in their use, however, since they are neither as compact or inexpensive as a wave washer.

Figure 7:
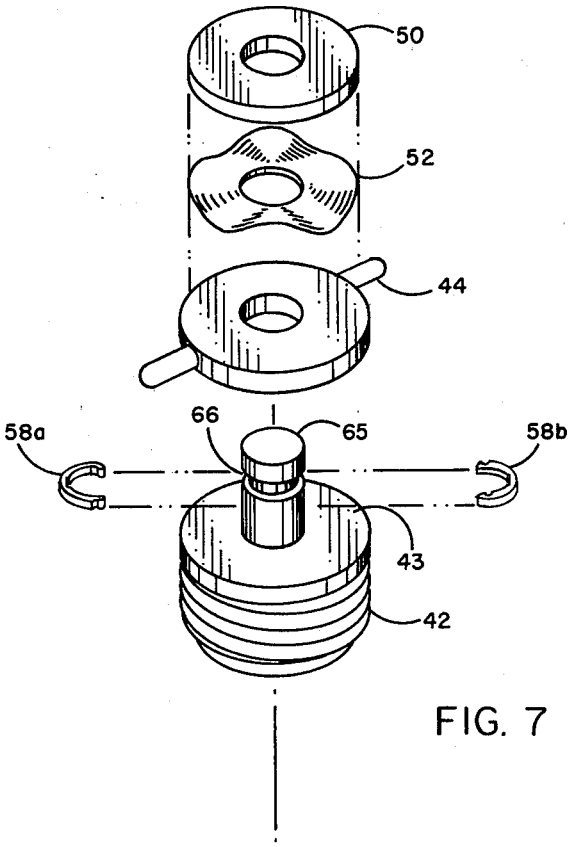
FIG. 7 illustrates a bucket cap in a third embodiment thereof.

FIG. 7, there is shown a second alternate embodiment which differs from the first alternate embodiment only in the substitution of a retaining ring type fastener for the nut 48 of FIG. 5. For this modification, center post 65 is provided with a groove 66 adapted to receive retaining ring halves 58*a* and 58*b* which retain hanger rod 44, wave washer 52 and flat washer 50 in stacked assembly with center post 65.

While in accordance with the patent statutes there has been described what at present is considered to be the preferred embodiments of the invention, it will be understood by those skilled in the art that various changes and modifications may be made therein without departing from the invention and it is, therefore, the aim of the appended claims to cover all such changes and modifications as fall within the true spirit and scope of the invention.

What is claimed is:

1. A swinging bucket centrifuge rotor including a rotor head adapted for rotation about a vertical axis, said rotor head having top, peripheral and bottom surfaces and a plurality of chambers evenly spaced about said vertical axis, each of said chambers being constructed to receive and support a bucket on a hanger rod for pivotal movement of said bucket between a vertical position when the rotor head is stationary and a horizontal position when centrifugal force developed through rotation of said rotor head overcomes the influence of gravity on said bucket, each of said chambers comprising:

a cavity having a longitudinal axis and extending entirely through said rotor head;

a slot in the bottom of said rotor head extending from said cavity to the peripheral surface of said rotor, said slot having an upper surface and adapted to receive said bucket when it is in a horizontal position; and a pair of opposed grooves extending part way down the wall of said cavity, the end of said grooves being situated on a horizontal line orthogonal to a vertical plane which includes said vertical axis and said longitudinal axis, the ends of said grooves forming a ledge in the wall of the cavity to support the end portions of said hanger rod and thereby enable said bucket to pivot under centrifugal force upwardly into said slot in said rotor head.

2. A swinging bucket centrifuge rotor including a rotor head adapted for rotation about a vertical axis, said rotor head having top, peripheral and bottom surfaces and a plurality of chambers evenly spaced about said vertical axis, each of said chambers being constructed to receive and support a bucket on a hanger rod for pivotal movement of said bucket between a vertical position when the rotor is stationary and a horizontal position when centrifugal force developed through rotation of said rotor head overcomes the influence of gravity on said bucket, each of said chambers comprising:

a cavity having a longitudinal axis and extending entirely through said rotor head;

a slot in the bottom of said rotor head extending from said cavity to the peripheral surface of said rotor head, said slot having an upper surface and adapted to receive said bucket when it is in a horizontal position;

a pair of opposed grooves extending part way down the wall of said cavity, the end of said grooves being situated on a horizontal line orthogonal to a vertical plane which includes said vertical axis and said longitudinal axis, the ends of said grooves forming a ledge in the wall of said cavity to support the end portions of said hanger rod and enable said bucket to pivot under centrifugal force upwardly into said slot in said rotor head;

buckets having a tubular portion closed at one end and provided with a flange structure adjacent the other end, said other end having a threaded opening, a threaded cap for closing said opening, a hanger rod attached to said cap for mounting the bucket in the cavity;

a shoulder at the junction of said cavity and said slot adapted to be contacted by the flange structure of said bucket when it is in the horizontal position, and thereby transfer support of the bucket from the hanger rod to the rotor head.

3. In a centrifuge system including a rotor head adapted for rotation about a vertical axis, said rotor head having top, peripheral and bottom surfaces and a plurality of chambers evenly spaced about said vertical axis, each of said chambers being constructed to receive and support a bucket on a hanger rod for pivotal movement of said bucket between a vertical position when the rotor is stationary and a horizontal position when centrifugal force developed through rotation of said rotor head overcomes the influence of gravity on said bucket, each of said chambers comprising:

a cylindrical cavity having a longitudinal axis disposed parallel to said vertical axis and extending entirely through said rotor head;

a slot in the bottom of said rotor head extending from said cavity to the periphery surface of said rotor head, said slot having an upper surface and adapted to receive said bucket when it is in a horizontal position;

a pair of opposed grooves extending part way down the wall of said cavity, the end of said grooves being situated on a horizontal line orthogonal to a vertical plane which includes said vertical axis and said longitudinal axis, the ends of said grooves forming a ledge in the wall of said cavity to support the end portions of said hanger rod and enable said bucket to pivot under centrifugal force upwardly into said slot in said rotor head;

a circular recess formed in the wall of said cavity, said circular recess including a conical shoulder therein, said recess and shoulder nominally concentric with a line passing through the center of said cavity and said vertical axis;

buckets having a tubular portion closed at one end and provided with a flange structure adjacent the other end, said other end having a threaded opening, a threaded cap for closing said opening, a hanger rod attached to said cap for mounting the bucket in the cavity;

said conical shoulder at the junction of said cavity and said slot adapted to be contacted by the flange structure of said bucket when it is in the horizontal position, and thereby transfer support of the bucket from the hanger rod to the rotor.

4. The centrifuge system of claim 3, wherein said hanger rod comprises a flexible beam which is deflectable under centrifugal load to enable said bucket to displace radially outward during centrifugation.

5. The centrifugation system of claim 3, wherein said hanger rod comprises a stiff member mounted on the cap of said bucket in conjunction with spring means to enable said bucket to displace radially during centrifugation.

6. The centrifugation system of claim 5, wherein said spring means comprise a wave washer.

* * * * *